US006926565B2

(12) United States Patent
Fogg

(10) Patent No.: US 6,926,565 B2
(45) Date of Patent: Aug. 9, 2005

(54) CONTACT FOR HIGH SPEED CONNECTORS

(75) Inventor: Michael W. Fogg, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/701,340

(22) Filed: Nov. 4, 2003

(65) Prior Publication Data

US 2004/0142606 A1 Jul. 22, 2004

Related U.S. Application Data

(60) Provisional application No. 60/424,263, filed on Nov. 6, 2002.

(51) Int. Cl.[7] ..... H01R 4/48
(52) U.S. Cl. ..... 439/862
(58) Field of Search ..... 439/637, 733.1, 439/495–496, 630, 862

(56) References Cited

U.S. PATENT DOCUMENTS 5,102,346 A * 4/1992 Soes ..... 439/268
5,474,468 A * 12/1995 Chishima et al. ..... 439/495
5,904,589 A * 5/1999 Asakawa ..... 439/495
5,921,785 A * 7/1999 Ii ..... 439/60
6,227,917 B1 * 5/2001 Chou ..... 439/862

* cited by examiner

*Primary Examiner*—J. F. Duverne

(57) ABSTRACT

A contact is provided for use in an interface connector. The contact comprises a contact beam 12 having a mating surface proximate a first end of the contact beam. The mating surface 16 is configured to join a contact pad, such as on a module board to carry high speed data signals therebetween. The contact further includes a tail portion configured to join a contact pad, such as on a host board. A leg portion of the contact joins and interconnects the tail portion and a second end of the contact beam. The leg portion includes a retention segment, through which a signal transmission path passes as data signals are carried through the leg portion between the tail portion and contact beam, thereby reducing signal degradation. The retention segment is configured to secure the leg portion within a connector.

32 Claims, 9 Drawing Sheets

CONTACT FOR HIGH SPEED CONNECTORS

RELATED APPLICATION

The present applications relates to, and claims priority from, provisional application Ser. No. 60/424,263, filed on Nov. 6, 2002, titled "CONTACT FOR HIGH SPEED SMALL FORM FACTOR PLUGGABLE CONNECTOR", the full and complete subject matter of which is expressly hereby incorporated in its entirety by reference.

BACKGROUND OF THE INVENTION

The present invention generally relates to a contact and a connector configured to carry data at high speeds. More specifically, certain embodiments of the present invention relate to a contact for use in various connectors.

Recently, interface connectors have been developed that are capable of satisfying a common specification for multi-source applications, such as in the telecommunications field, data communications applications, storage area networks and the like. The connectors convey data at very high data rates and should satisfy very strict signal quality criteria. The connectors are used in applications that have very demanding space constraints and thus are developed to satisfy various form factor.

These connectors interconnect a variety of components, such as host boards and daughter boards that carry transceiver ASICs and the like. In certain applications, the connector may be a 20 to 70 position pluggable transceiver (PT) connector that carries digital data signals at high data rates, such as 2.5, 5, and 10 Gbps (gigabits per second ) or higher.

However, as data rate increases, the signal performance of the conventional connectors declines. The signal performance may be characterized in terms of jitter, return loss, insertion loss, attenuation, reflectance, signal to noise ratio and the like. The performance of the connector is affected by several factors, one factor of which is the shape and configuration of the contacts that carry the data signals through the connector. Contacts of conventional design have been found to exhibit declining performance characteristics once the data rate reaches and exceeds 5 or 10 Gbps and higher.

FIG. 9 illustrates a conventional contact 310 designed for small form factor pluggable connectors to carry digital signals at a data rate of up to 2.5 Gbps. The contact 310 is held in a housing of a connector 305. The contact 310 includes a contact beam 312 that is joined to one end of a leg portion 320. An opposite end of the leg portion 320 joins a tail portion 332. The contact beam 312 and tail portion 332 define interfaces at which data signals are conveyed to mating contact pads 357 and 355 on a module board 358 and host board 354, respectively. The contact 310 includes a retention stub 322 that holds the contact 310 in place in the connector 305. The retention stub 322 includes a base end formed with the leg portion 320 at an intermediate point along the length of the leg portion 320. The retention stub 322 projects at a right angle from the leg portion 320 with an outer end 324 terminating at a point remote from the contact 310.

The contact 310 exhibits satisfactory performance at data rates of at least 2.5 Gbps. However, when the data rate is increased to near 10 Gbps and higher the retention stub 322 begins functioning as an electrical stub which causes signal degradation, such as increased jitter, insertion loss, return loss and the like.

A need exists for an improved contact configuration that overcomes the problems noted above and experienced heretofore by convention contacts.

BRIEF SUMMARY OF THE INVENTION

A contact is provided for use in an interface connector. The contact comprises a contact beam having a mating surface proximate a first end of the contact beam. The contact beam is configured to carry high speed data signals. The contact further includes a tail portion configured to carry high speed data signals. A leg portion of the contact joins and interconnects the tail portion and a second end of the contact beam. The leg portion includes a retention segment, through which a signal transmission path passes as data signals are carried through the leg portion between the tail portion and contact beam. The retention segment is configured to secure the leg portion within a connector.

Optionally, the retention segment many be U-shaped and include first and second stems extending parallel to one another and being joined at one end. The stems are open at an opposite end, at which the first and second stems join the tail portion and leg portion, respectively. The signal transmission path passes through the first and second stems continuously along the U-shape. When the retention segment is formed in a U-shape, the contact's overall shape forms a general S-shape through which the signal transmission path travels.

In accordance with an alternative embodiment, a connector is comprised of a housing having first and second ends configured to mate with adjoining elements, such as module and host boards. The connector includes a contact held in the housing that has a contact beam configured to join a contact pad on an adjoining element. The contact includes a tail portion also configured to join a contact pad on an adjoining element. The contact beam and tail portion are joined by a leg portion that includes a retention segment formed continuously within the signal transmission path through the leg segment between the tail portion and contact beam. The retention segment secures the leg portion within the housing.

In accordance with an alternative embodiment, a method is provided for transmitting a high speed data signal in a carrier wave through contacts in an electrical connector. The method comprises transmitting data signal pairs in a high speed data signal over contacts in the connector at a data rate of at least 10 Gbps. The method further includes directing the data signal pairs along corresponding signal transmission paths through corresponding contacts that maintain a predetermined signal performance such that the jitter of the data signal pair at the contacts does not substantially exceed 11 picoseconds.

In accordance with at least one alternative embodiment, a method is provided for transmitting a high speed data signal in a carrier wave through contacts in a connector. The method comprises transmitting a data signal in a high speed data signal over a contact in a connector at a data rate of approximately at least 10 Gbps (e.g., 9.9–10.7 Gbps). The method further includes directing the data signal along a signal transmission path through the contact that maintains a predetermined signal performance such that insertion loss does not substantially exceed −3 dB up to the third harmonic (e.g., 15 GHz) of the fundamental frequency (e.g., 5 GHz) of the 10 Gbps data rate.

In accordance with an alternative embodiment, a method is provided for transmitting a high speed data signal and carrier wave through a contact in a connector. The method comprises transmitting a data signal in a high speed data signal over a contact in a connector at a data rate of at least 10 Gbps. The method includes directing the data signal along a signal transmission path through the contact that maintains a predetermined signal performance such that the return loss does not substantially exceed the insertion loss for frequencies between 5 and 15 GHz.

Figure 1:
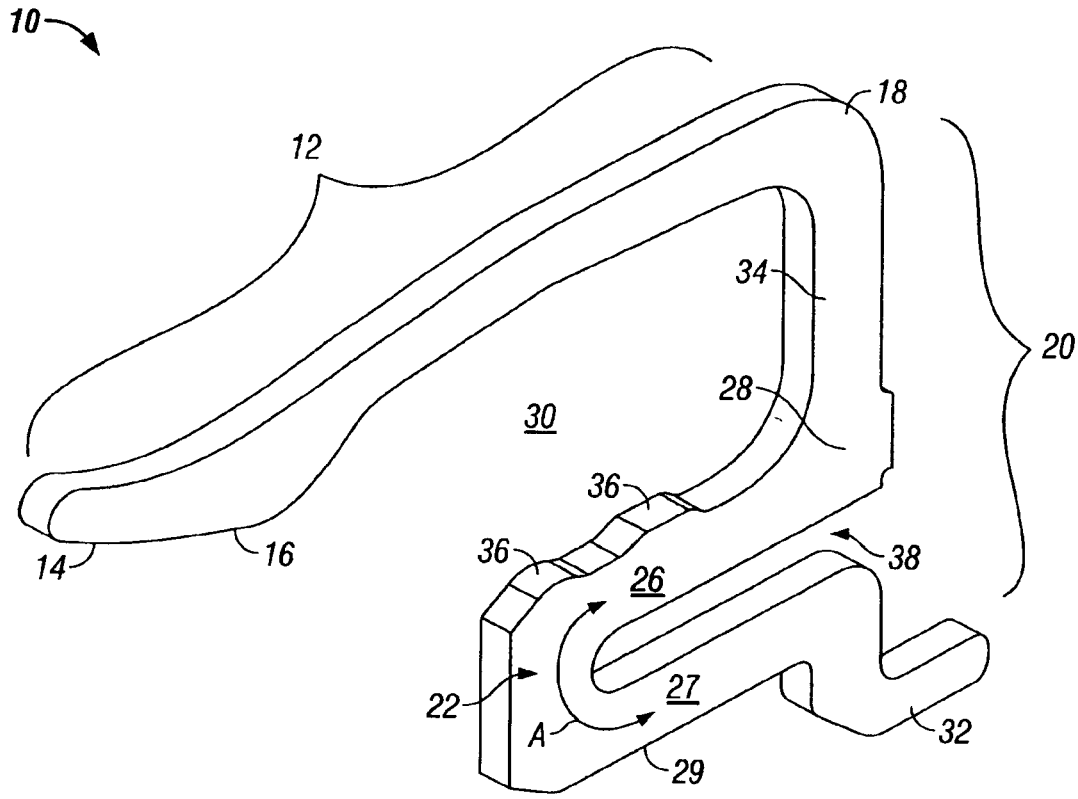
FIG. 1 illustrates an isometric view of a contact formed in accordance with an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 illustrates a contact 10 formed in accordance with an embodiment of the present invention. The contact 10 is configured to be secured in a housing of a connector, such as a small form factor pluggable connector. The contact 10 may be used in a variety of other connectors and applications that convey signals at high data rates and desire high quality signal performance. By way of example, the contact 10 may carry digital data having a fundamental frequency of 5 GHz and a data rate of 10 Gbps and higher, while exhibiting very little jitter, insertion loss and return loss.

The contact 10 includes a contact beam 12 having an outer end with an optional lead-in surface 14 adjacent a mating surface 16. The lead-in surface 14 is curved upward to facilitate loading of another component, such as a host board, daughter board and the like. When the host board or other component is fully inserted, contact (mating) pads on the host board firmly engage the mating surface 16 in a tangential alignment. Optionally, the mating surface 16 may be on the top or outer end of the contact beam 12, or may constitute a pin insertable into an adjoining contact.

Figure 2:
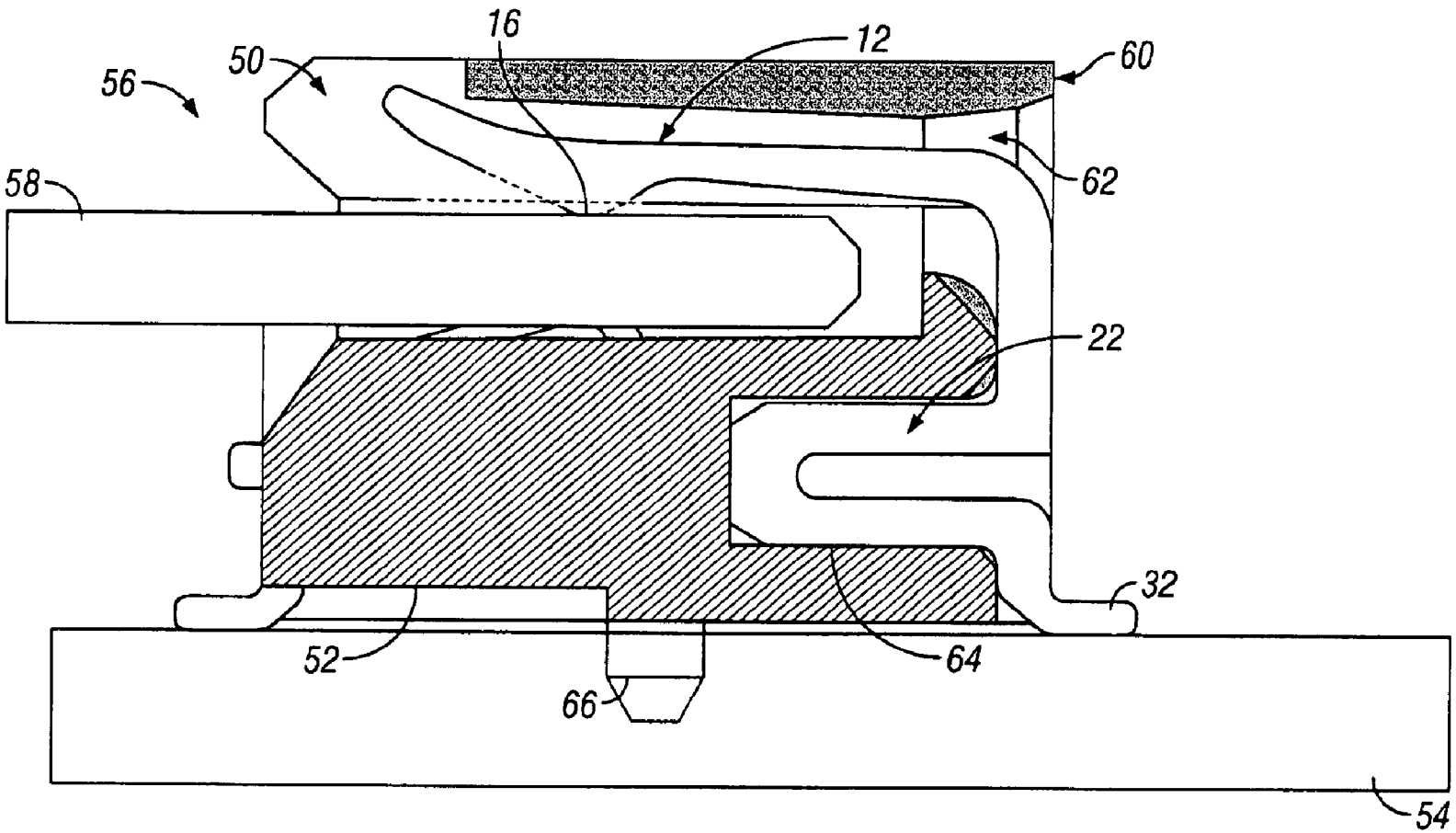
FIG. 2 illustrates a side sectional view of a contact held in a connector formed in accordance with an embodiment of the present invention.

The contact 10 also includes a leg portion 20 having one end joined at bend 18 with the contact beam 12. The leg portion 20 has an opposite end joining a tail portion 32 that may extend beyond a rear face 60 of the connector 50. As shown in FIG. 2, the tail portion 32 extends beyond the rear face 60 of the connector 50 into which the contact 10 is loaded. While tail portion 32 is shown bent to extend beyond the contact 10, optionally the tail portion 32 may be 1) bent in the opposite direction under the contact 10, 2) shortened to be even with rear face 60, or 3) turned downward to serve as a pin or otherwise. The tail portion 32 is configured to join a contact pad on a mating component, such as a host board 54 and the like. Optionally, the tail portion 32 may be soldered, surface mounted, or inserted as a pin to join with the host board 54.

The leg portion 20 includes a brace segment 34 having an upper end joining the contact beam 12 generally at a right angle. A lower end of the brace segment 34 is formed at bend 28 with a retention segment 22. The retention segment 22 is configured to securely retain the contact 10 in a channel within the housing of a connector 50 (FIG. 2). The brace segment 34 spaces the contact beam 12 and retention segment 22 apart from one another by a distance sufficient to define a mating area 30 therebetween. A module board 58 (FIG. 2) is inserted into the mating area. The retention segment 22 is oriented parallel to, and extends in the same direction as, the contact beam 12. The retention segment 22 is generally U-shaped and includes upper and lower stems 26 and 27, respectively. First ends of the upper and lower stems 26 and 27 are joined to one another proximate the contact beam 12, while opposite rear ends 38 of the upper and lower stems 26 and 28 are open. The rear end 38 of the lower stem 28 joins the tail portion 32, which extends downward and rearward in a stepped manner.

Optionally, the retention segment 22 may extend in the direction opposite to the contact beam 12. Alternatively, the retention segment 22 may be oriented at an acute or obtuse angle with the contact beam 12. The retention segment 22 may have other shapes, such as C-shaped, S-shaped, square, arc-shaped, triangular, and the like.

The upper and lower stems 26 and 27 provide an opening at the rear end 38 to define a signal transmission path through the entire retention segment 22 (as denoted by arrow A) that is continuous, uninterrupted and lacking in termination points. When data signals are conveyed through the contact 10, they pass from the mating surface 16 along the contact beam 12, through the brace segment 34, and around the upper stem 26 and lower stem 27 until reaching the tail portion 32. Of course, data signals may be conveyed in the reverse direction instead, beginning at the tail portion 32 and traveling to the contact beam 12.

The upper stem 26 includes projections 36 formed on the upper edge thereof. The projections 36 are dimensioned such that they, in combination with a lower edge 29 of the lower stem 27, form an interference fit within a channel in the connector.

FIG. 2 illustrates a side sectional view of a connector 50 that may utilize the contact 10. The connector 50 includes a base 52 mounted on a host board 54 and includes a front face 56 that receives a module board 58. The connector 50 includes a rear face 60 having a passage 62 formed therein that extends to the front face 56. The contact beam 12 extends into the passage 62 to a depth proximate the front face 56. The rear face 60 also includes a channel 64 that is dimensioned to firmly receive the retention segment 22. The tail portion 32 is mounted to a contact pad 55 on the host board 54, while the mating surface 16 on the contact beam 12 abuts against a contact pad 57 on the module board 58.

Optionally, a pin 66 may be mounted in the host board 54 to retain the connector 50 thereon.

Figure 3:
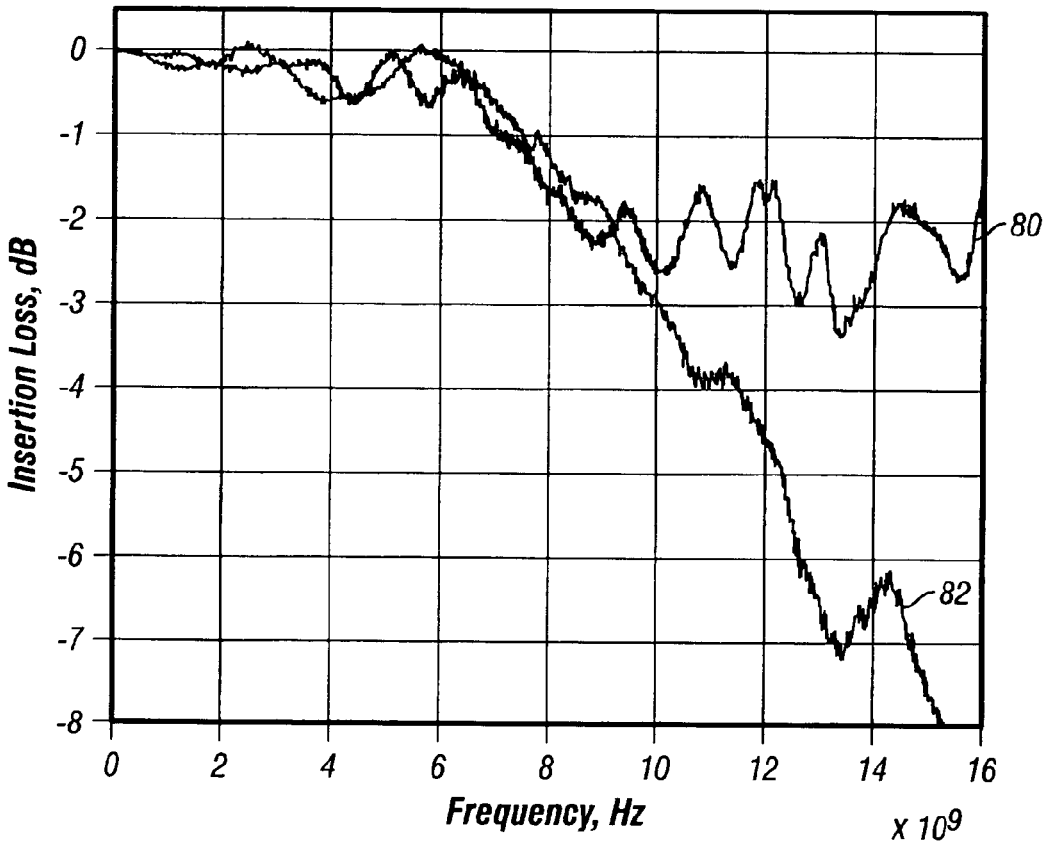
FIG. 3 illustrates a graph plotting insertion loss at various data rates experienced by the contact of FIG. 1 versus the contact of FIG. 9.

FIG. 3 illustrates a graph plotting insertion loss in decibels (dB) on the vertical axis and frequency in Gigahertz (GHz) on the horizontal axis. Insertion loss represents an attenuation of the data signal that results from the addition of a device into a system characterized as a transmission line. The insertion loss represents the reciprocal of the ratio of 1) the signal power delivered to the point in the transmission line where the device is added and 2) the signal power at the same point in the transmission line before the device is added.

Figure 9:
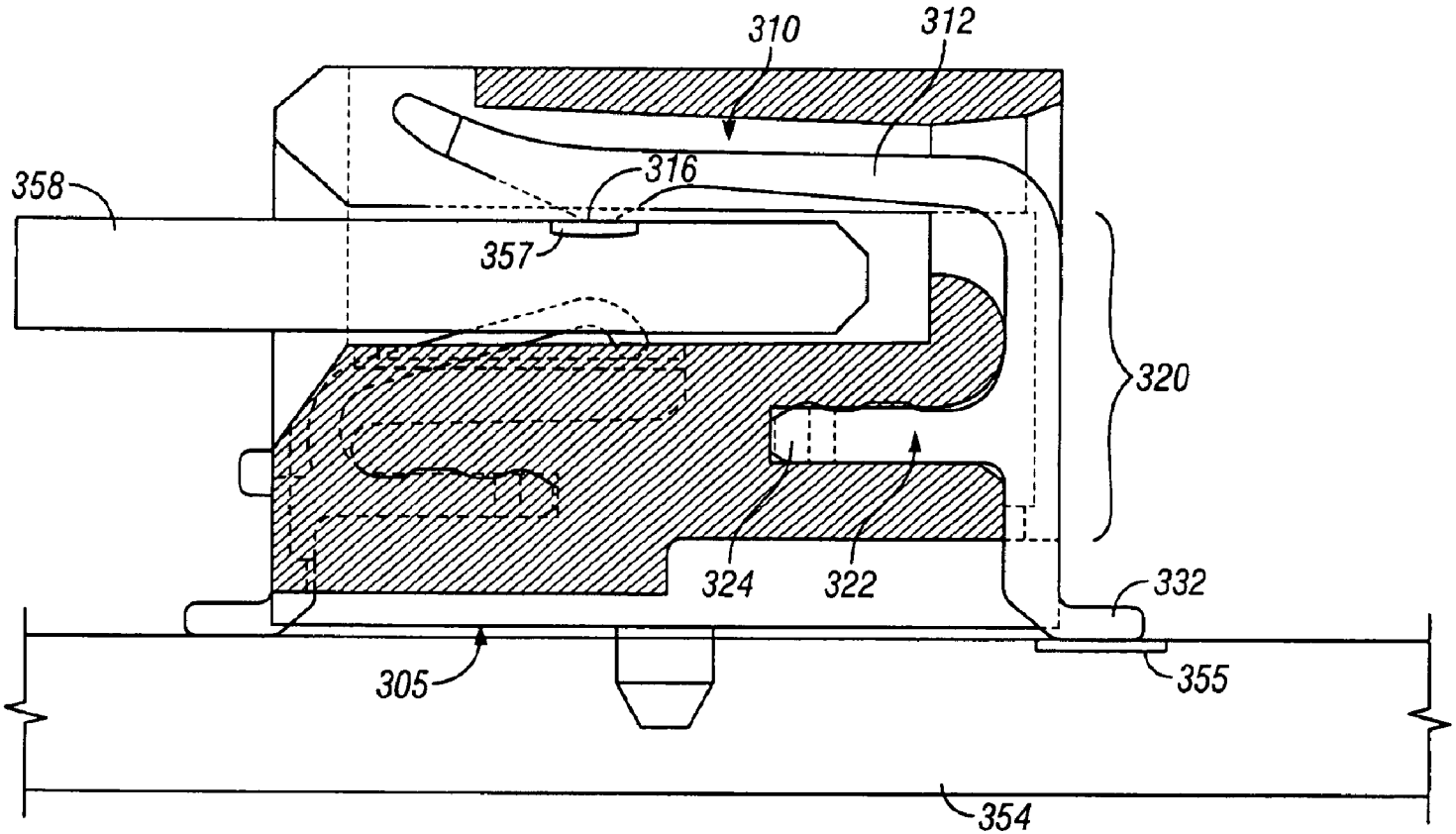
FIG. 9 (Prior Art)
FIG. 9 illustrates a side section view of a conventional contact held in a connector.

In FIG. 3, line 80 represents the insertion loss introduced by contact 10 (FIG. 2) into a data signal carrying data at a rate of approximately 10 Gigabits per second (Gbps). The insertion loss of contact 10 is measured at the contact pad 57 on the module board 58 (FIG. 2) and the contact pad 55 on the host board 54. The line 82 represents the insertion loss introduced by contact 310 (FIG. 9) into a data signal also carrying data at a rate of approximately 10 Gbps. The insertion loss of contact 310 is measured at the contact pads 357 and 355 on the module board 358 and host board 354, respectively.

It is understood that the data signal is comprised of frequency components spanning a broad frequency range. Each frequency component experiences insertion loss to a different degree. In FIG. 3, the insertion loss is shown for the frequency components, between 0 and 16 GHz, that are comprised in a data signal having a 10 Gbps data rate. For example, the 2 GHz frequency component conveyed through contacts 10 and 310 experiences very little insertion loss. The frequency components between 7 and 8 GHz, conveyed through contacts 10 and 310 experience approximately 1 dB of insertion loss. Of particular interest, the insertion loss introduced by contact 10 does not substantially exceed −2.5 dB for any frequency component up to 12.5 GHz, and does not substantially exceed −3 dB for any frequency component up to 16 GHz. It should be noted that 10 GHz and 15 GHz frequency components are the second and third harmonics of the fundamental frequency (5 Ghz) of the data signal. As is apparent from FIG. 3, the conventional contact 310 exhibits substantially more insertion loss at frequencies above 10 GHz as compared to contact 10.

Figure 4:
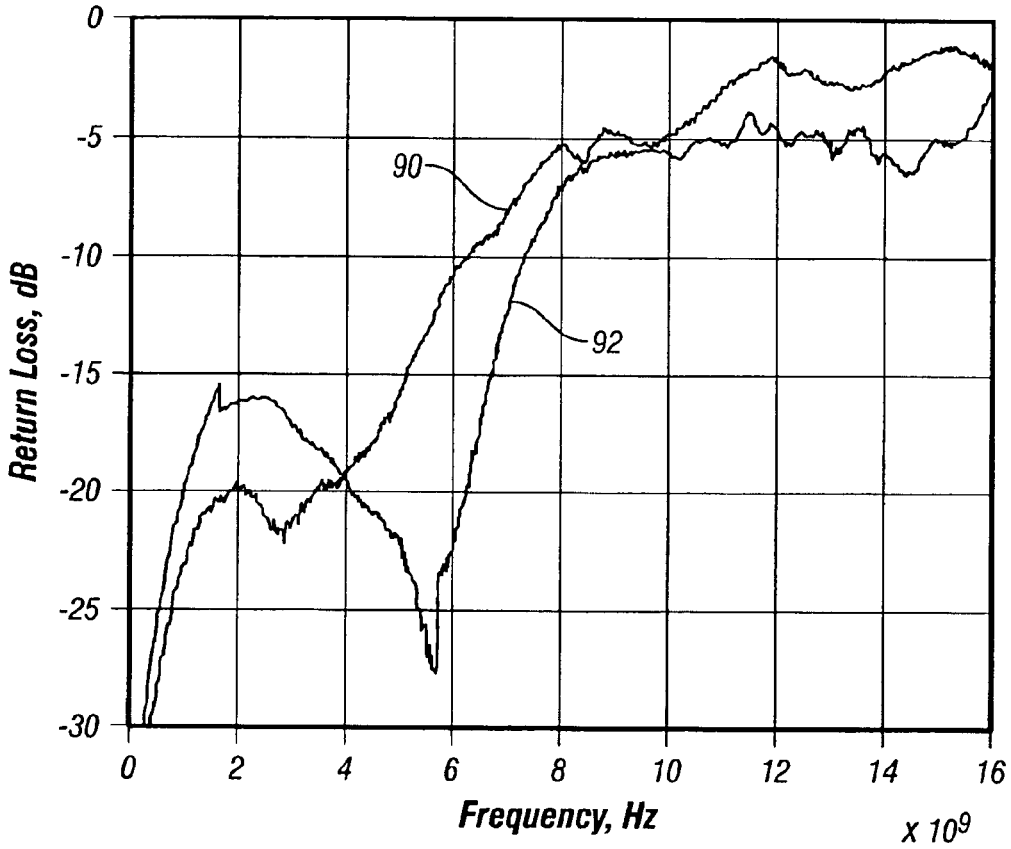
FIG. 4 illustrates a graph plotting return loss at various data rates experienced by the contact of FIG. 1 versus the conventional contact of FIG. 9.

FIG. 4 illustrates a graph plotting return loss in dB on the vertical axis and frequency in GHz on the horizontal axis. Return loss represents a summation of the reflected signal energy returning backward toward an end of a transmission line from which the signal originates (e.g., an echo signal). For example, in bi-directional signaling applications, a transceiver may be placed at each end of the transmission line. The transmitter within each transceiver sends a data signal through the transmission line and then begins "listening" over the same line for data that is transmitted from the opposite end. The reflected or echo signals interfere with the desired data signals. Return loss may be caused by discontinuities and impedance mismatches within the transmission line. For purposes of this exemplary embodiment, it may be assumed that the data path between the module board 58, contact 10 and host board 54 form a transmission line. Discontinuities within a transmission line occur at connection points, such as at contact pad 57 and at contact pad 55. Impedance mismatches may occur between components within a transmission line or within a single component, device or cable.

In the conventional contact 310 (FIG. 9), the retention stub 322 functioned as an electrical stub for the higher frequency components of the data signal. As the retention stub 322 functioned more and more as an electrical stub, it varies the electrical characteristics of the contact 310 including, among others, its impedance. As the electrical characteristics (such as, but not limited to, the impedance) of the contact 310 vary, insertion loss, return loss and the like increase. The line 90 (in FIG. 4) represents the return loss of contact 10 (FIG. 1) measured at and including the contact pad 57 on the module board 58 and, at and including the contact pad 55 on the host board 54 while carrying digital data signals at approximately 10 Gbps (e.g., 9.9–10.7 Gbps). The line 92 represents the return loss of a contact 310 (FIG. 9) measured at the contact pads 357 and 355.

FIG. 4 illustrates the frequency components between 0 and 16 GHz that comprised a data signal having a 10 Gbps data rate. The return loss of the contact 10 for the 5 GHz frequency component is no greater than −15 dB. The return loss of the contact 10 for the 10 GHz and 15 GHz frequency components at do not exceed −5 dB and −2.5 dB, respectively. The frequency components at 5 GHz, 10 GHz and 15 GHz represent the fundamental, second harmonic and third harmonic frequencies of the exemplary data signal.

The measurements plotted in FIGS. 3 and 4 are taken at the contact pads 55, 355, 57 and 357 to account for the interconnections at the tail portions 32, 322 and mating surfaces 16, 316. The contact pads 55 and 355 may represent solder pads, while the contact pads 57 and 357 may represent mating pads.

Figure 5:
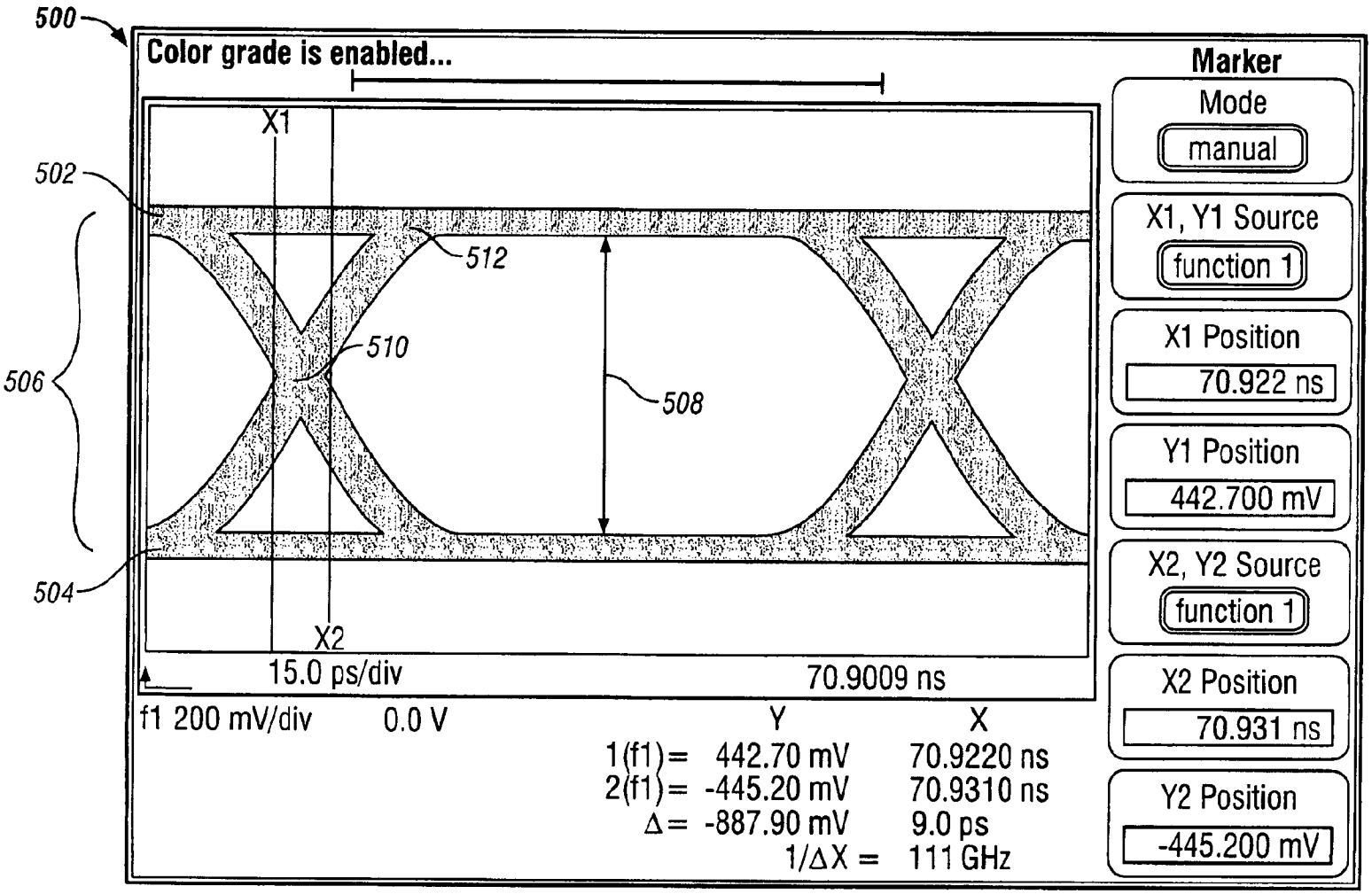
FIG. 5 illustrates an eye pattern representing the performance exhibited by a reference cable carrying data signals at 10 Gbps.
Figure 6:
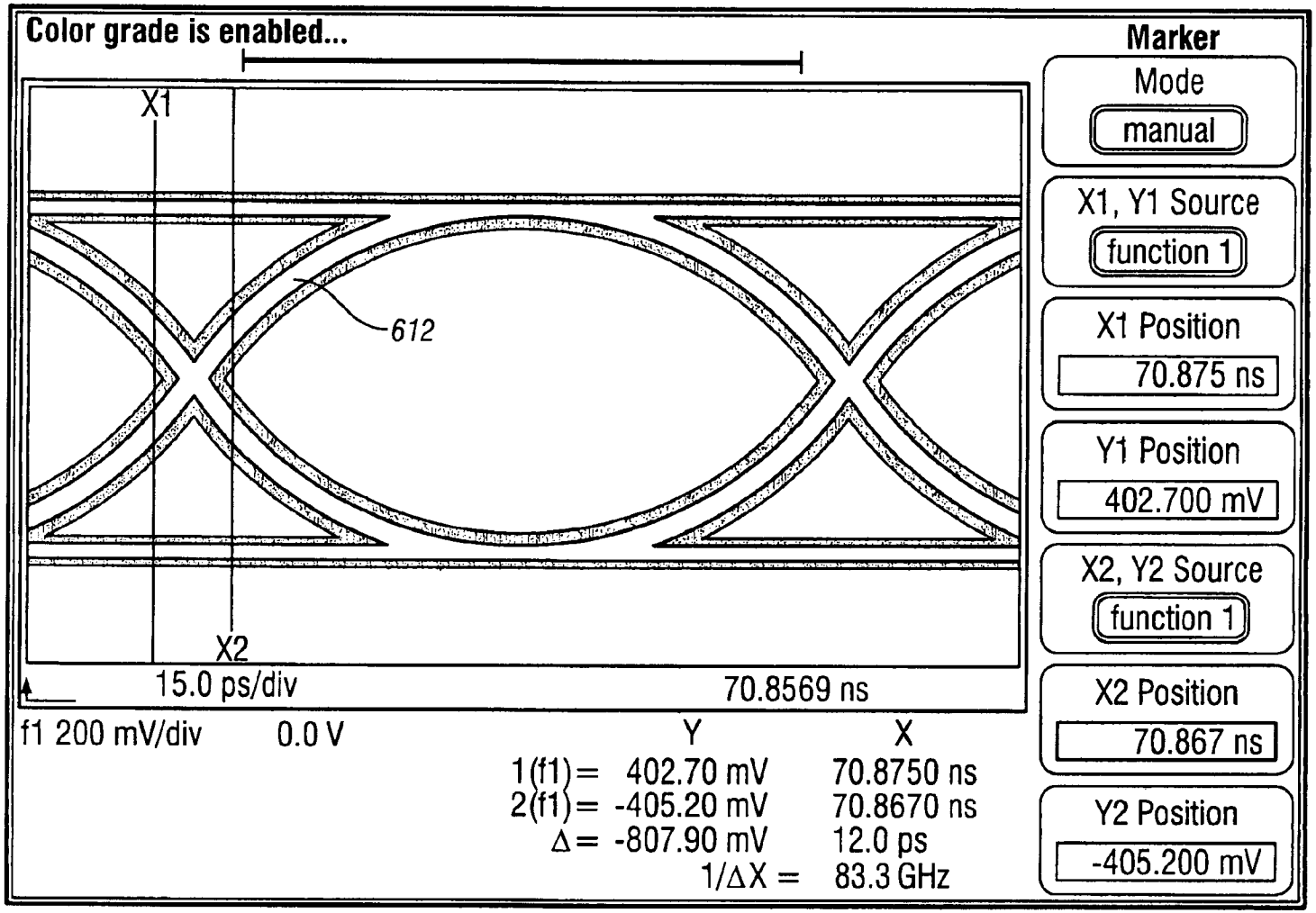
FIG. 6 illustrates an eye pattern representing the performance exhibited by the conventional contact of FIG. 9 carrying data signals at 10 Gbps.
Figure 7:
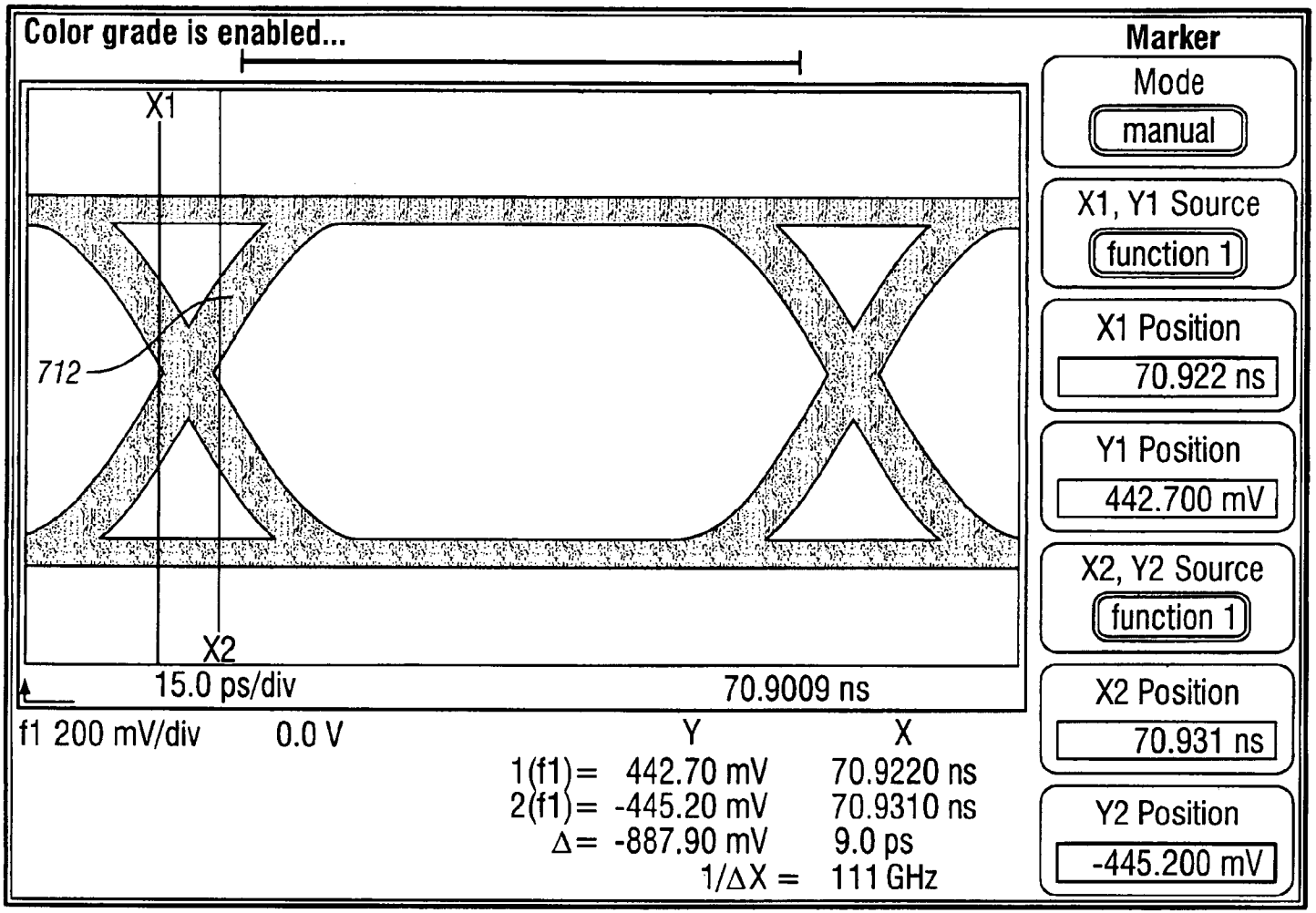
FIG. 7 illustrates an eye pattern representing the performance exhibited by a reference cable carrying data signals at 10 Gbps.

FIGS. 5–8 illustrate eye patterns for reference cables (FIGS. 5 and 7), the conventional contact 310 (FIG. 6), and contact 10 (FIG. 8) at contact pads 55 or 57, and 355 or 357. The eye patterns in FIGS. 5 and 7 represent the data signal introduced into the contacts 310 and 10 at contact pats 55 and 57, and 355 or 357. An eye pattern represents an oscilloscope display in which a pseudo-random digital data signal from a receiver is repetitively sampled and applied to the vertical input of the oscilloscope, while the data rate is used to trigger the horizontal sweep of the oscilloscope. In the example of FIGS. 5–8, the data rate is 5 Gbps. The reference signal included a data stream containing pseudo-randomly generated data words, where each data word contained 127 bits ($2^7$−1 PRBS). The data signal was driven by a 5 GHz clock to produce a 10 Gbps data rate. As shown in FIGS. 5 and 7, the reference cables (without any contact attached thereto) exhibited a 9 ps (picosecond) jitter and contained an 887 mV eye amplitude).

With reference to FIG. 5, the eye pattern 500 includes top and bottom rails 502 and 504, respectively. The distance 506 between the centers of the top and bottom rails 502 and 504 corresponds to the signal amplitude. The thickness or width of each of the top and bottom rails 502 and 504 corresponds to the noise amplitude. The eye opening 508 represents the distance between the top and bottom rails 502 and 504. The temporal width (along the horizontal axis) of the crossing section 510 represents the amount of jitter in the signal. In the referenced cable of FIG. 5, the eye opening 508 has a value of 887 mV, while the jitter 510 has a value of 9 ps.

The rising edge 512 of the reference cable in FIG. 5 completes a state transition of approximately 800 mV in approximately 45 ps (the divisions on the horizontal axis are 15 ps/division, and on the vertical axis are 200 mV/division. FIG. 7 illustrates the performance of a reference cable substantially similar to that of FIG. 5, but attached to the contact 10 (shown in FIG. 1). The signal performance of the reference cable in FIG. 7 exhibits an eye opening of 887 mV and a jitter of 9 ps.

With reference to FIG. 6, the conventional contact 310 exhibits an eye opening having a value of 808 mV, with a jitter equal to 12 ps. In addition, FIG. 6 illustrates the rising edge 612 of the data signal passed through conventional contact 310. The rising edge 612 of the data signal through contact 310 requires over 75 ps to complete the state transition of approximately 800 mV.

Figure 8:
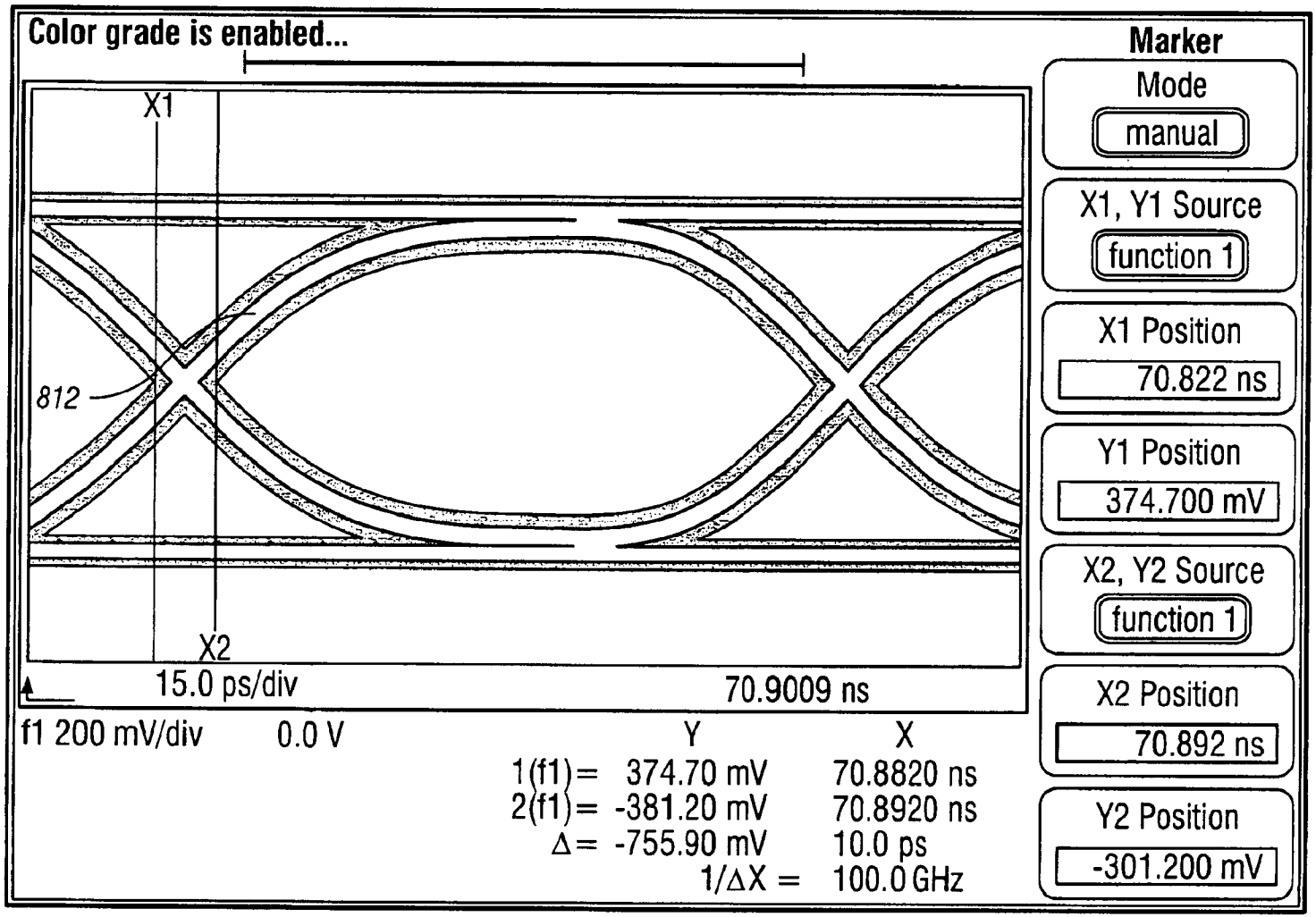
FIG. 8 illustrates an eye pattern representing the performance exhibited by the contact of FIG. 1 formed according to an embodiment of the present invention carrying data signals at 10 Gbps.

In FIG. 8, the contact 10 (FIG. 1) exhibits a signal performance having an eye opening of 756 mV and a jitter of approximately 10 ps. In addition, the rising edge 812 of the data signal is less rounded as compared to the rising edge 612 (FIG. 6) of the conventional contact 310. The rising edge 812 of the data signal through contact 10 requires no more than 60 ps to complete the state transition. The data signal conveyed by contact 10 exhibits a steeper or faster rise/fall time to transition between states as compared to the conventional contact 310. A steeper rise time affords more time for the transceiver circuitry to gate or acquire each data value (e.g., a logic 0 or a logic 1) in the data signal. The improvement in rise time is due in part to the reduction, by the contact 10, of insertion and return losses. By reducing the insertion and return losses, the signal quality is improved which in turn affords a steeper or faster rise/fall time, reduces jitter and introduces less distortion.

As shown above, the insertion and return losses are reduced by providing an electrical contact with more stable electrical characteristics over a wider frequency range. By way of example, the contact 10 exhibits a substantially even impedance along its length and over a large frequency range, up through the third harmonic of the fundamental frequency of the data transmission rate. For example, a data rate of 10 Gbps which is driven by a clock operating at 5 GHz per second has a third harmonic of approximately 15 GHz. As shown in FIGS. 3 and 4, the insertion and return loss (lines 80 and 90) of contact 10 maintained a much more stable and even performance over frequencies of 5 GHz and higher, as compared to the insertion and return losses (82 and 92) exhibited by the conventional contact 310. At frequencies above 5 and 10 GHz, the retention stub 322 (FIG. 9) of the conventional contact 310 begins functioning as an electric stub. As an electrical stub, the retention stub 322 begins operating as a parallel transmission line that progressively interferes more with the characteristics of the higher frequency components. By way of example, when the length of the retention stub 322 equals $\frac{1}{4}^{th}$ of the wave length, the retention stub 322 forms a short circuit which drastically degrades the operation of the contact 310.

The contact 10 (FIG. 1) avoids stubs or other structure that would otherwise operate as an electrical stub, thereby avoiding the problems experienced by the conventional contact 310. The structure of the contact 10 supports data transmission at high frequencies (as shown in FIGS. 3 and 4) with less insertion and return loss, thereby improving the signal quality and affording a steeper/faster rise/rise time for the transition of the data signal between states, as well as reducing jitter and introducing less distortion.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims. Optionally, multiple contact 10 may be held in a common housing and configured to transmit data signal pairs.

What is claimed is:

1. A contact for use in a connector, said contact comprising:

a contact beam having a mating surface proximate a first end of said contact beam, said contact beam being configured to carry high speed data signals;

a tail portion configured to carry high speed data signals; and a leg portion joining and interconnecting said tail portion and a second end of said contact beam, said leg portion including a retention segment, through which a signal transmission path passes, as data signals are conveyed through said leg portion between said tail portion and said contact beam, said retention segment being configured to secure said leg portion within a connector, wherein said retention segment is incorporated continuously into said signal transmission path such that data signals conveyed at a data rate of approximately at least 10 Gbps through said mating surface of said contact beam exhibit attenuation of less than −3 dB for frequencies up to a third harmonic of a fundamental frequency of said data signals.

2. The contact of claim 1, wherein said contact is stamped and formed with said contact beam, tail portion and leg portion being aligned in a common plane.

3. The contact of claim 1, wherein said leg portion includes a brace segment interconnecting said second end of said contact beam and said retention segment, said brace segment, contact beam and retention segment forming a mating area configured to accept an edge of a circuit board.

4. The contact of claim 1, wherein said retention segment is U-shaped and includes first and second stems joined at one end and open at an opposite end, said signal transmission path passing through said first and second stems continuously along said U-shape.

5. The contact of claim 1, wherein said retention segment includes first and second stems joined at one end proximate said mating surface of said contact beam, said first and second stems being open at an opposite end proximate said tail portion.

6. The contact of claim 1, wherein said leg portion and contact beam form a general S-shape through which said signal transmission path travels.

7. The contact of claim 1, wherein said retention segment is incorporated continuously into said signal transmission path such that data signals conveyed at a data rate of at least 10 Gbps through said mating surface of said contact beam exhibit jitter at said mating surface of less than 11 picoseconds.

8. A contact for use in a connector, said contact comprising:

a contact beam having a mating surface proximate a first end of said contact beam, said contact beam being configured to carry high speed data signals;

a tail portion configured to carry high speed data signals; and a leg portion joining and interconnecting said tail portion and a second end of said contact beam, said leg portion including a retention segment, through which a signal transmission path passes, as data signals are conveyed through said leg portion between said tail portion and said contact beam, said retention segment being configured to secure said leg portion within a connector;

wherein said retention segment is incorporated continuously into said signal transmission path such that data signals conveyed at a data rate of approximately at least 10 Gbps through said mating surface of said contact beam exhibit a return loss that does not exceed an insertion loss for frequencies less than a third harmonic of fundamental frequency of said data signal.

9. A connector, comprising:

a housing; and a contact held in said housing, said contact having a contact beam configured to carry high speed data signals and a tail portion configured to carry high speed data signals, said contact beam and said tail portion being joined by a leg portion, said leg portion including a retention segment formed continuously within a signal transmission path through said leg portion between said tail portion and said contact beam, said retention segment secures said leg portion within said housing, wherein said retention segment is incorporated continuously into said signal transmission path such that data signals conveyed at a data rate of approximately at least 10 Gbps through said contact exhibit a return loss that does not exceed an insertion loss for frequencies less than a third harmonic of fundamental frequency of said data signal.

10. The connector of claim 9, wherein said contact is stamped and formed with said contact beam, tail portion and leg portion being aligned in a common plane.

11. The connector of claim 9, wherein said leg portion includes a brace segment interconnecting said second end of said contact beam and said retention segment, said brace segment, contact beam and retention segment forming a mating area configured to accept an edge of a circuit board.

12. The connector of claim 9, wherein said retention segment is U-shaped and includes first and second stems joined at one end and open at an opposite end, said transmission path passing through said first and second stems continuously along said U-shape.

13. The connector of claim 9, wherein said retention segment includes first and second stems joined at one end proximate said mating surface of said contact beam, said first and second stems being open at an opposite end proximate said tail portion.

14. The connector of claim 9, wherein said leg portion and contact beam form a general S-shape through which said signal transmission path travels.

15. The connector of claim 9, wherein said retention segment is incorporated continuously into said signal transmission path such that data signals conveyed at a data rate of at least 10 Gbps through said contact exhibit jitter at said mating surface of less than 11 picoseconds.

16. A contact for use in a connector, said contact comprising:

a contact beam having a mating surface proximate a first end of said contact beam, said contact beam being configured to carry high speed data signals;

a tail portion configured to carry high speed data signals; and a leg portion joining and interconnecting said tail portion and a second end of said contact beam, said leg portion including a retention segment, through which a signal transmission path passes, as data signals are conveyed through said leg portion between said tail portion and said contact beam, said retention segment being configured to secure said leg portion within a connector;

wherein said retention segment is incorporated continuously into said signal transmission path such that data signals convey at a data rate of approximately at least 10 Gbps through said contact exhibit attenuation of less than −3 dB for frequencies up to a third harmonic of a fundamental frequency of said data signals.

17. A method of transmitting a high-speed data signal in a carrier wave through contacts in a connector, said method comprising:

transmitting, through a contact in a connector, a high speed data signal with a predetermined fundamental frequency and at a data rate of approximately at least 10 Gbps, said data signal having insertion loss; and directing the data signal along a signal transmission path through the contact that maintains a predetermined signal performance such that said insertion loss does not substantially exceed −3 dB up to a third harmonic of said fundamental frequency of said data signal.

18. The method of claim 17, wherein said transmitting step includes transmitting said data signal at a fundamental frequency of approximately 5 GHz.

19. The method of claim 17, wherein said directing step prevents said insertion loss from substantially exceeding −3 dB for all frequency components of said data signal of 15 GHz and less.

20. The method of claim 17, wherein said data signal includes a 10 GHz frequency component and a 15 GHz frequency component having between 1 and 3 dB of insertion loss.

21. The method of claim 17, wherein said data signal includes second and third harmonic frequency components having less than 3 dB of insertion loss.

22. The method of claim 17, wherein said transmitting step includes transmitting a differential pair of data signals through a corresponding pair of contacts.

23. A method of transmitting a high-speed data signal in a carrier wave through contacts in a connector, said method comprising:

transmitting, through a contact in a connector a high speed data signal with a predetermined fundamental frequency and at a data rate of approximately at least 10 Gbps, said data signal having insertion loss and return loss; and directing the data signal along a signal transmission path through the contact that maintains a predetermined signal performance such that said return loss does not substantially exceed said return loss for frequencies between said fundamental frequency and a third harmonic of said fundamental frequency.

24. The method of claim 23, wherein said transmitting step includes transmitting said data signal at a fundamental frequency of approximately 5 GHz.

25. The method of claim 23, wherein said directing step prevents said insertion loss from substantially exceeding −3 dB for all frequency components of said data signal of 15 GHz and less.

26. The method of claim 23, wherein said data signal includes a 10 GHz frequency component and a 15 GHz frequency component having between 1 and 3 dB of insertion loss.

27. The method of claim 23, wherein said data signal includes second and third harmonic frequency components having less than 3 dB of insertion loss.

28. The method of claim 23, wherein said transmitting step includes transmitting a differential pair of data signals through a corresponding pair of contacts.

29. The method of claim 17, wherein said transmitting step transmits said data signal through a contact that includes a retention segment configured to secure the contact in a connector.

30. The method of claim 23, wherein said transmitting step transmits said data signal through a contact that includes a retention segment configured to secure the contact in a connector.

31. The method of claim 17, wherein the contact includes an U-shaped retention segment and wherein said directing step directs said data signal through the U-shaped retention segment.

32. The method of claim 23, wherein the contact includes an U-shaped retention segment and wherein said directing step directs said data signal through the U-shaped retention segment.

* * * * *